US006330791B1

(12) United States Patent
Kendall et al.

(10) Patent No.: US 6,330,791 B1
(45) Date of Patent: Dec. 18, 2001

(54) BURNER FOR OPERATING GAS TURBINES WITH MINIMAL $NO_X$ EMISSIONS

(75) Inventors: Robert M. Kendall, Sunnyvale; Steven J. Greenberg, Santa Clara, both of CA (US)

(73) Assignee: Alzeta Corporation, Santa Clara, CA (US)

( * ) Notice: Subject to any disclaimer, the term of this patent is extended or adjusted under 35 U.S.C. 154(b) by 0 days.

(21) Appl. No.: 09/666,058

(22) Filed: Sep. 20, 2000

Related U.S. Application Data

(62) Division of application No. 09/235,209, filed on Jan. 22, 1999, now Pat. No. 6,199,364.

(51) Int. Cl.[7] ..... F23R 3/06
(52) U.S. Cl. ..... 60/39.11; 60/753; 431/329
(58) Field of Search ..... 60/39.11, 753, 60/754; 431/326, 328, 329

(56) References Cited

U.S. PATENT DOCUMENTS 2,447,482 * 8/1948 Arnold ..... 60/754
4,311,447 * 1/1982 Rackley et al. ..... 431/328
4,657,506 * 4/1987 Ihlenfield et al. ..... 431/329
5,439,372 * 8/1995 Duret et al. ..... 431/326

* cited by examiner

*Primary Examiner*—Louis J. Casaregola
(74) *Attorney, Agent, or Firm*—Paul W. Garbo

(57) ABSTRACT

A porous, low-conductivity material formed of metal or ceramic fibers provides the burner face of a gaseous fuel combustor for gas turbines capable of minimizing nitrogen oxides ($NO_X$) emissions in the combustion product gases. A preferred burner face, when fired at atmospheric pressure, yields radiant surface combustion with interspersed areas of blue flame combustion. A rigid but porous mat of sintered metal fibers with interspersed bands of perforations is illustrative of a preferred burner face that can be fired at pressures exceeding 3 atmospheres at the rate of at least about 500,000 BTU/hr/sf/atm. By controlling the excess air admixed with the fuel in the range of about 40% to 150% to maintain an adiabatic flame temperature in the range of about 2600° F. to 3300° F., the $NO_X$ emissions are suppressed to 5 ppm and even below 2 ppm. At all times, carbon monoxide and unburned hydrocarbons emissions do not exceed 10 ppm, combined.

15 Claims, 5 Drawing Sheets

BURNER FOR OPERATING GAS TURBINES WITH MINIMAL $NO_X$ EMISSIONS

RELATED APPLICATIONS

This is a Division of Ser. No. 09/235,209 filed Jan. 22, 1999 (U.S. Pat. No. 6,199,364).

BACKGROUND OF THE INVENTION

This invention relates to a burner and process for operating gas turbines with minimal emissions of air pollutants, especially nitrogen oxides ($NO_X$). More particularly, the burner and process permit operation of gas turbine combustors at high excess air and at elevated pressure.

The development of a compact burner that would fit in the castings of gas turbines and yield combustion products with a limited content of atmospheric pollutants [$NO_X$, carbon monoxide (CO) and unburned hydrocarbons (UHC)] has long failed to deliver a commercially acceptable product. In 1981, U.S. Pat. No. 4,280,329 of Rackley et al disclosed a radiant surface burner in the form of a porous ceramic V-shaped element. Theoretically, the proposed burner was attractive but, practically, it had serious deficiencies, such as fragility, high pressure drop therethrough and limited heat flux. No advance in the art of radiant surface combustion for gas turbines has appeared since the Rackley et al proposal.

Efforts to minimize atmospheric pollutant emissions from the operation of gas turbines have been directed in different approaches. U.S. Pat. Nos. 4,339,924; 5,309,709 and 5,457,953 are illustrative of proposals involving complicated and costly apparatus. Catalytica Inc. Is promoting a catalytic combustor for gas turbines which reportedly (San Francisco Chronicle, Nov. 21, 1996) is undergoing evaluation. None of the proposals provide simple, compact apparatus and catalysts are expensive and have limited lives.

A principal object of this invention is to provide compact burners for gas turbines which feature surface-stabilized combustion conducted at high firing rates with high excess air to yield minimal polluting emissions.

Another important object is to provide burners for gas turbines which permit broad adjustment of heat flux.

A related object is to provide compact burners with low pressure drop and stable operation over a broad pressure range and excess air variation.

Still another object is to provide burners for gas turbines which have simple and durable construction.

A further primary object of the invention is to provide a method of operating gas turbines to yield combustion products with a very low content of atmospheric pollutants.

These and other features and advantages of the invention will be apparent from the description which follows.

SUMMARY OF THE INVENTION

Basically, the burner face used in this invention is a porous, low-conductivity material formed of metal or ceramic fibers and suitable for radiant surface combustion of a gaseous fuel-air mixture passed therethrough. A preferred burner face is a porous metal fiber mat which, when fired at atmospheric pressure, yields radiant surface combustion with interspersed portions or areas of increased porosity that provide blue flame combustion. Such a burner face is shown in FIG. 1 of U.S. Pat. No. 5,439,372 to Duret et al who disclose a rigid but porous mat of sintered metal fibers with interspersed bands or areas of perforations. One supplier of a porous metal fiber mat is N.V. Acotech S. A. of Zwevegem, Belgium. As shown by the patentees, bands of perforations are formed in the porous mat to provide blue flame combustion while the adjacent areas of the porous mat provide radiant surface combustion.

Another form of porous metal fiber mat sold by Acotech is a knitted fabric made with a yarn formed of metal fibers. While the yarn is porous, the interstices of the knitted fabric naturally provide uniformly interspersed spots of increased porosity. Hence, the knitted metal fiber fabric provides surface radiant combustion commingled with numerous spots of blue flames.

Still another form of porous burner face suitable for this invention is the perforated, ceramic fiber plate disclosed in U.S. Pat. No. 5,595,816 to Carswell having small perforations effective for radiant surface combustion, which is simply modified to have interspersed areas with larger perforations for blue flame combustion.

Another version of a perforated, ceramic or metal fiber plate adapted for this invention is one having uniform perforations that produce blue flame combustion, but such a plate is combined with an upstream configuration that limits flow to selected portions of the plate such that those portions operate with surface combustion in or near a radiant mode. One embodiment of this approach could simply involve another perforated plate, slightly spaced from the upstream side of the main plate. The perforations of the back-up plate are of a size and distribution that some of its perforations are aligned with perforations of the main plate so that the latter perforations support blue flame combustion. The unperforated portions of the back-up plate that are aligned with perforations of the main plate impede the flow of the fuel-air mixture to these perforations so that they yield surface combustion. The back-up plate need not be a low-conductivity plate like the main plate that is the burner face. In this case, the back-up plate obviously serves to diminish the flow of the fuel-air mixture through selected areas of the perforated, ceramic or metal fiber plate.

A perforated back-up plate may also be used with the various other forms of burner face previously described; usually the back-up plate helps to ensure uniform flow of the fuel-air mixture toward all of the burner face. With the knitted fabric formed of a metal fiber yarn, the back-up plate provides support for the fabric as well as uniform flow thereto. Hence, a perforated back-up plate can have a different function depending on the burner face with which it is combined. Inasmuch as the burner face will in most cases be cylindrical, as hereinafter described, the back-up plate that may also be cylindrical will hereafter be called perforated shell.

The complete burner of the invention has a porous fiber burner face attached across a plenum with an inlet for the injection of a gaseous fuel-air mixture, a perforated shell within the plenum behind the burner face, and a metal liner positioned to provide a compact combustion zone adjacent to the burner face. Such a burner has been successfully operated at high firing rates or high heat-flux and with high excess air to produce combustion gases containing not more than 5 ppm $NO_X$ and not more than 10 ppm CO and UHC, combined. Through the control of excess air, the burner is capable of delivering combustion gases containing not more than 2 ppm $NO_X$ and not more than 10 ppm CO and UHC, combined. All ppm (parts per million) values of $NO_X$, CO and UHC mentioned in the specification and claims are values corrected to 15% $O_2$, the gas turbine standard.

At the high surface firing rates required for burners that can be fitted in the casings of gas turbines, say at least about 500,000 BTU/hr/sf (British Thermal Units per hour per square foot) of burner face, the flames from the areas of increased porosity produce such intense non-surface radiation that the normal surface radiation from the areas of lower porosity disappears. However, the dual porosities make it possible to maintain surface-stabilized combustion, i.e., surface combustion stabilizing blue flames attached to the burner face. For brevity, burners having faces with dual porosities will be referred to as surface-stabilized burners.

Visually, flaming is so compact that a zone of strong infrared radiation seems suspended close to the burner face. The compactness of flaming is aided by the metal liner that confines combustion adjacent the burner face. Even though this surface-stabilized combustion is conducted with about 40% to 150% excess air depending on inlet temperature, the combustion products may contain as little as 2 ppm $NO_X$ and not more than 10 ppm CO and UHC, combined.

The aforesaid firing rate of at least about 500,000 BTU/hr/sf of burner face is for combustion at atmospheric pressure. Inasmuch as gas turbines operate at elevated pressures, the base firing rate must be multiplied by the pressure, expressed in atmospheres. For example, at an absolute pressure of 150 pounds per square inch or 10 atmospheres, the nominal minimum firing rate becomes 5,000,000 BTU/hr/sf. It is entirely unexpected and truly remarkable that stable operation of the surface-stabilized burner at high pressure permits a firing rate or heat flux as high as 15,000,000 BTU/hr/sf. This heat flux is calculated to be at least ten times that of the porous ceramic fiber burner of the aforesaid Rackley et al patent; moreover, the ceramic fiber coating of the burner would disintegrate at high pressure and high gas flow operation.

BRIEF DESCRIPTION OF THE DRAWINGS

To facilitate the description and understanding of the invention, reference will be made to the accompanying drawings of which.

DESCRIPTION OF PREFERRED EMBODIMENTS

Figure 1:
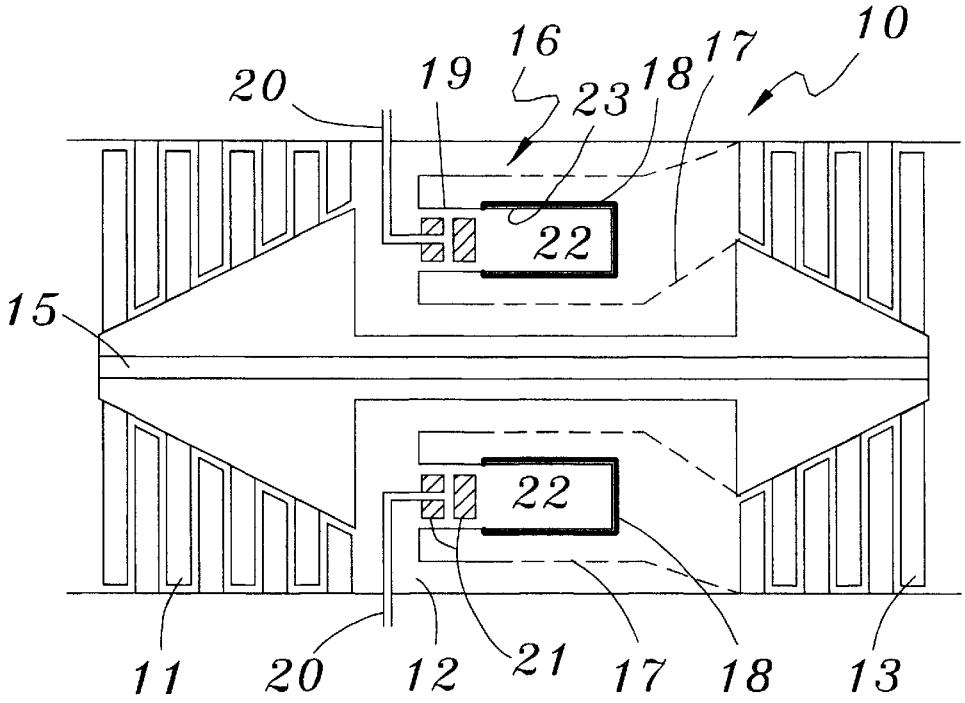
FIG. 1 is a schematic representation of one embodiment of the gas burners of the invention in an annular arrangement positioned between a typical air compressor and gas turbine.

FIG. 1 schematically depicts a gas turbine 10 with the discharge portion of air compressor 11, combustion section 12, and the inlet portion of turbine 13. Compressor 11 and turbine 13 share a common axle 15. Burners 16 having a face 18 with dual porosities are disposed in combustion section 12 annularly around shaft 15. Two burners 16 are shown in FIG. 1 but, depending on the size of gas turbine 10, usually six to twelve burners 16 will be uniformly spaced from one another in combustion section 12 around shaft 15. Each burner 16 is cylindrical and has outer metal liner 17 spaced from burner face 18.

Part of the compressed air leaving compressor 11 enters cylindrical neck 19 of each burner 16 and the remainder flows exteriorly of liners 17. Each burner 16 is supplied gaseous fuel by tube 20 extending through the casing of gas turbine 10. Tube 20 discharges between two spaced blocks 21 (or through multiple radial holes in a single block 21) in neck 19, causing the gaseous fuel to flow radically in all directions into the compressed air flowing through neck 19. The resulting admixture of fuel and air fills burner plenum 22. Thence, the fuel-air mixture passes through perforated shell 23 spaced from dual porosity burner face 18. Shell 23 helps in providing uniform flow through all of burner face 18. Upon ignition, the mixture exiting burner face 18 burns in the form of a compact zone of combustion that visually seems flameless over the regions of low porosity and has a stable flame pattern over the regions of high porosity (hereinbefore called surface-stabilized combustion). Essential to combustion pursuant to this invention is feeding a fuel-air mixture with 40% to 150% excess air at a firing rate of at least 500,000 BTU/hr/sf/atm.

Some of the compressed air from compressor 11 flows through combustion section 12 in the space between and around the several cylindrical metal liners 17 which have multiple openings for the passage of air therethrough. Thus, the compressed air not used for combustion serves to cool metal liners 17 and to cool the products of combustion prior to entry into turbine section 13. Liners 17 extend to the entrance of turbine section 13 and deliver a still hot pressurized gas mixture to turbine 13 to drive its rotor and produce power. The expanded gas mixture leaving engine 13 may discharge to a waste heat recovery system (not shown). The closed end of burners 16 are shown in FIG. 1 with burner face 18 and perforated shell 23. Optionally, the end may be sealed with a solid plate but, of course, the burner will then have less combustion capacity.

Figure 2:
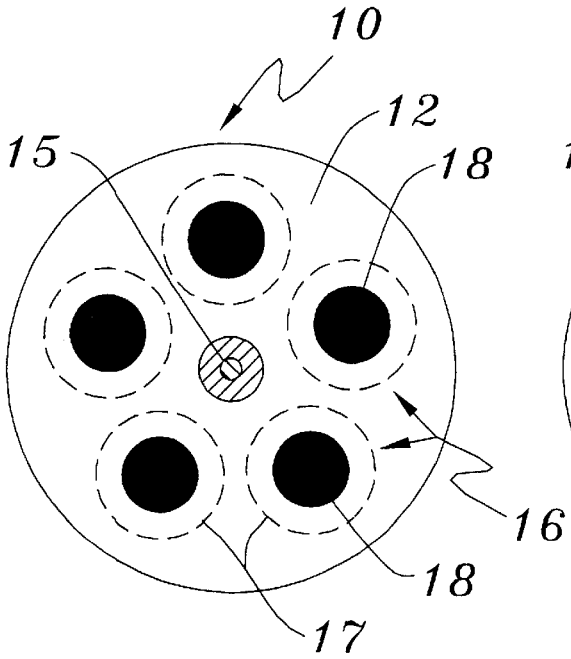
FIG. 2 and FIG. 3 are sectional views of different arrays of burners around the shaft connecting the compressor and the turbine.

FIG. 2 is a simplified view of five burners 16, taken parallel to their closed ends, uniformly spaced around shaft 15 within combustion zone 12 of gas turbine 10. The five burners 16 include individual metal liners 17.

Figure 3:
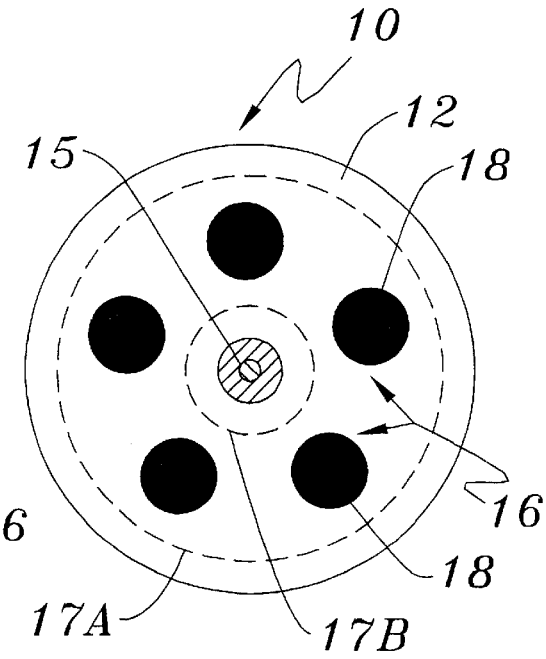

FIG. 3 is identical to FIG. 2 except that individual liners 17 have been replaced by a pair of metal liners 17A and 17B that confine the combustion of all five burners 16 in an annular zone. Compressed air to cool liners 17A and 17B and to enter the annular combustion zone through openings in liners 17A, 17B flows along the length of the outer surface of liner 17A and along the length of the inner surface of liner 17B.

Figure 4:
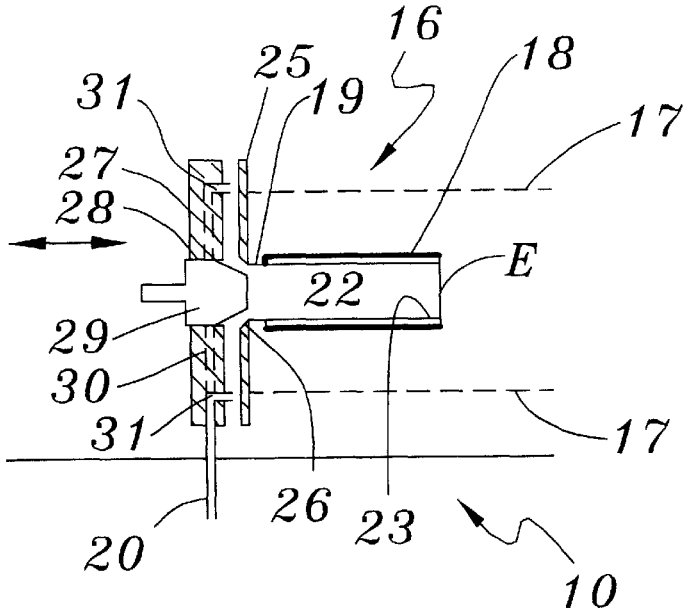
FIG. 4 and FIG. 5 are longitudinal sectional diagrams of different embodiments of the burner of the invention.

FIG. 4 shows a modified form of burner 16. The closed end E is sealed by an impervious disk protected by insulation (not shown). Short neck 19 is attached to a circular plate 25 having central tapered hole 26. Metal liner 17 is also attached to plate 25. Spaced from plate 25 is another circular plate 27 with central hole 28 in which tapered plug 29 is movable to adjust the gap between the tapers of hole 26 and plug 29. Gaseous fuel supply tube 20 passes through the shell of gas turbine 10 and is connected to an annular bore 30 in plate 27. Bore 30 has several (only two shown) right-angle openings 31 which discharge the gaseous fuel against plate 25. Compressed air flowing through the gap between plates 25,27 mixes with the gaseous fuel exiting openings 31 and fills plenum 22. Thence, the mixture passes uniformly through all of cylindrical, perforated shell 23 and burner face 18 to undergo surface-stabilized combustion in the compact zone between face 18 and metal liner 17. Compressed air that does not flow through the gap between plates 25,27 flows along the exterior surface of liner 17 to effect cooling thereof while some of the air passes through multiple openings in liner 17 to mix with the combustion product gases and thereby moderate the temperature thereof.

FIG. 4 serves to illustrate one way of ensuring thorough mixing of gaseous fuel and compressed air and one way of controlling the amount of compressed air flowing into plenum 22. By mechanical or pneumatic or electrical linkage (not shown) that extends from tapered plug 29 to the exterior of the shell of gas turbine 10, plug 29 can be moved to restrict or widen the gap between the tapers of plug 28 and hole 26, thereby controlling the amount of air admixed with the fuel. The means for moving plug 29 is not part of this invention and is within the purview of skilled mechanical workers.

Figure 5:
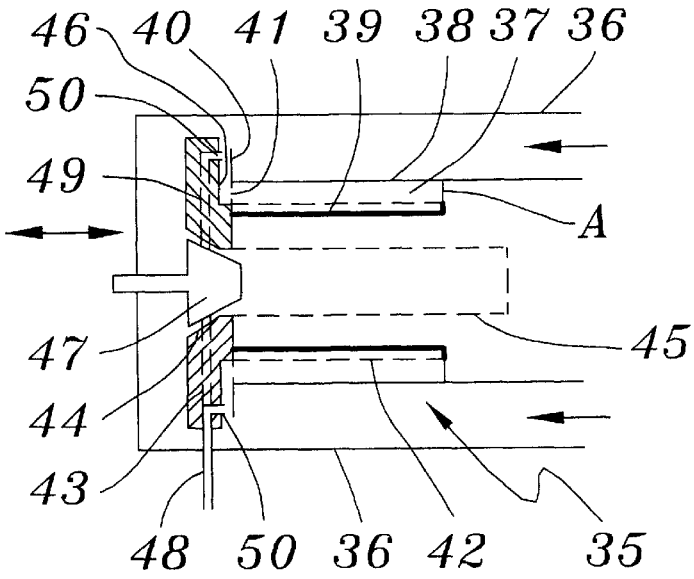

FIG. 5 shows a burner that differs from that of FIG. 4 in four principal aspects: compressed air flows to the burner countercurrent to the flow of combustion gases; the cylindrical burner fires inwardly instead of outwardly; the metal liner is within the burner instead of around it; the proportion of air from the compressor flowing into the plenum of the burner is indirectly controlled by varying the proportion allowed to by-pass the burner, i.e., not enter the plenum of the burner. Burner 35 is within a metal casing 36 which serves to channel compressed air toward the feed end of burner 35 having an annular plenum 37 formed between cylindrical metal wall 38 and cylindrical burner face 39. The feed end of plenum 37 has wall 38 and burner face 39 connected to an annular disk 40 that has multiple openings 41 circularly spaced from one another to act as inlets to plenum 37. The opposite end of cylindrical plenum 37 is closed by annular plate A connected to wall 38 and burner face 39. Perforated shell 42 within plenum 37 surrounds and is spaced from porous burner face 39 to promote uniform flow of fuel-air mixture toward all of burner face 39.

At the entry end of burner 35, circular block 43 is connected to annular disk 40 and has a central, tapered hole 44 that coincides with the opening of disk 40. Attached to disk 40 at its central opening is internal cylindrical metal liner 45. Compressed air flowing toward the entry to burner 35 can enter plenum 37 by flowing through the gap between disk 40 and recessed side 46 of block 43. Compressed air can simultaneously flow through the gap between tapered hole 44 and tapered plug 47. As discussed relative to the burner of FIG. 4, plug 47 can be moved to restrict or increase the flow of compressed air into cylindrical liner 45. In contrast to FIG. 4, the amount of air flowing into plenum 37 of burner 35 is indirectly controlled by allowing a variable proportion of all the air from the compressor to flow into liner 45 simply by moving tapered plug 46 toward or away from tapered hole 44.

Gaseous or vaporized fuel is supplied by tube 48 which passes through the shell of the gas turbine (not shown) in which metal casing 36 is installed. Tube 48 also passes through casing 36 and is connected to an annular bore 49 in circular block 43. Several uniformly spaced holes 50 from the recessed side 46 of block 43 to bore 49 serve for the injection of fuel into the gap between disk 40 and recessed side 46 of block 43. Compressed air flowing through that gap mixes thoroughly with the gaseous fuel injected by spaced holes 50 and the mixture flows into burner plenum 37. The mixture exiting porous burner face 39 undergoes surface-stabilized combustion in the confined annular space between burner face 39 and perforated liner 45. Compressed air flowing through liner 45 cools both liner 45 and the combustion product gasses by mixing therewith.

Figure 6:
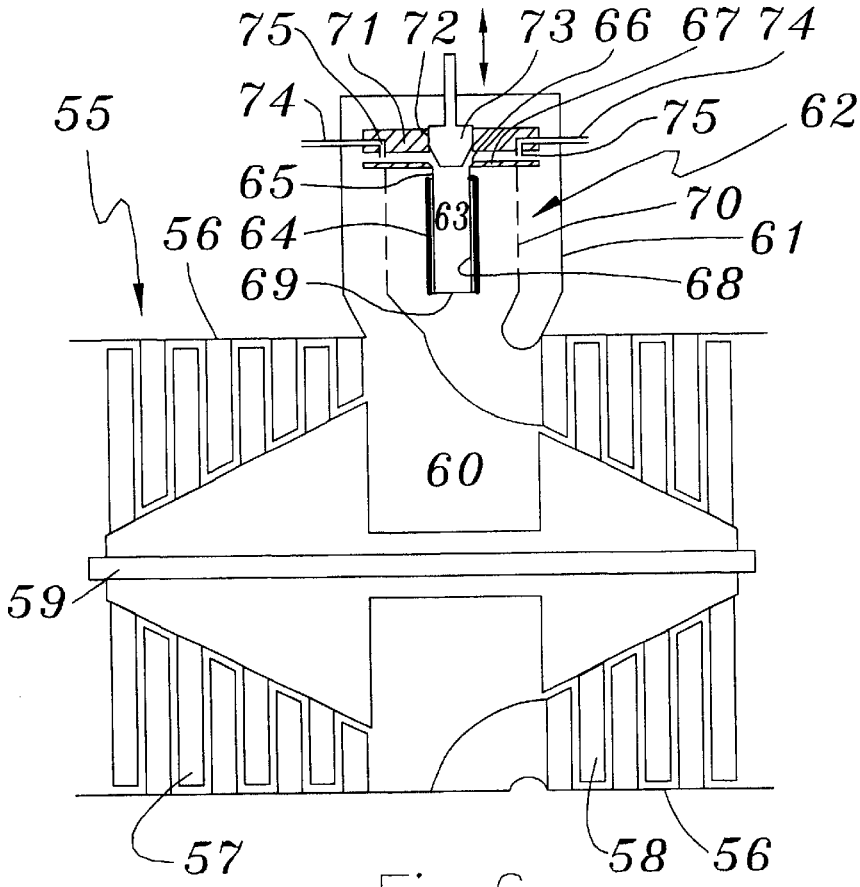
FIG. 6 differs from FIG. 1 in showing the burner in a housing outside the casing of the gas turbine.

Gas turbine 55 of FIG. 6 has casing 56 that encloses air compressor 57, turbine 58 and shaft 59 connecting 57,58. Between compressor 57 and turbine 58 is a channeled section 60 which directs the flow of air from compressor 57 into outer housing 61 attached to casing 56. Cylindrical burner 62 is suspended in housing 61.

Plenum 63 of burner 62 has dual porosity burner face 64 connected to burner neck 65 that is attached to tapered hole 66 in plate 67. Perforated shell 68 within plenum 63 is spaced from burner face 64 and promotes uniform flow of the fuel-air mixture toward all of face 64. Disk 69 with protective insulation (not shown) seals the end of plenum 63 opposite neck or inlet end 65. Metal liner 70 is spaced from and surrounds burner face 64, forming therebetween a confined combustion zone.

Spaced above plate 67 is block 71 with hole 72 centered over hole 66 in plate 67. Tapered plug 73 can slide up and down in hole 72 to vary the gap between the tapers of hole 66 and plug 73 and thus vary the quantity of compressed air flowing from housing 61 and between plate 67 and block 71 into plenum 63. Gaseous or vaporized fuel is supplied to burner 62 by several tubes 74 that pass through housing 61 and connect with nozzles 75 in block 71 which direct the fuel against plate 67 to effect good mixing with compressed air flowing along plate 67 and into plenum 63.

Surface-stabilized combustion takes place in the confined annular space between burner face 64 and liner 70. Air from compressor 57 filling housing 61 that does not flow into plenum 63 as an admixture with fuel injected through nozzles 75 flows through openings in liner 70 and blends with the combustion product gases. The blended gases are directed by channeled section 60 into turbine 58.

Figure 7:
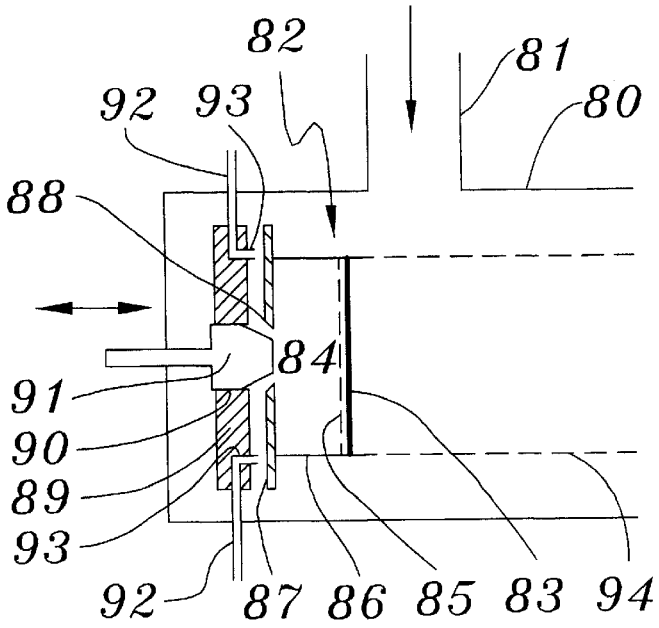
FIG. 7 like FIG. 5 shows still another embodiment of the burner of the invention.

The burner of FIG. 7 like that of FIG. 5 is within a metal casing 80 but air from the compressor enters radially through lateral duct 81 instead of longitudinally as indicated in FIG. 5. Burner 82, in contrast to previously described burners, has a flat burner face 83 extending across a pan-like plenum 84 containing perforated shell 85. This form of burner is well suited for the use of a knitted metal fiber fabric as burner face 83 with perforated shell 85 acting both as support for the fabric and as aid for uniform gas flow over all of face 83.

Lateral wall 86 of plenum 84 connects burner face 83 to plate 87 that has central tapered hole 88 serving as inlet to plenum 84. Spaced from plate 87 is block 89 with central hole 90. Tapered plug 91 in hole 90 can be moved toward or away from hole 88 in plate 87 to vary the flow of compressed air into plenum 84. Several tubes 92 pass through casing 80 and are connected to nozzles 93 in block 89. Gaseous fuel supplied by tubes 92 impinges on plate 87 and mixes with compressed air flowing from casing 80 into the space between plate 87 and block 89. The resulting mixture enters plenum 84 and exits through dually porous burner face 83 to undergo surface-stabilized combustion.

Attached to lateral wall 86 of pan-like plenum 84 is metal liner 94 with multiple openings which confines combustion in a tubular zone adjacent burner face 83. Compressed air in casing 80 which does not flow into plenum 84 to support combustion flows around liner 94 to cool it and to pass through the openings in liner 91 to cool the combustion gases by mixing therewith.

Figure 8:
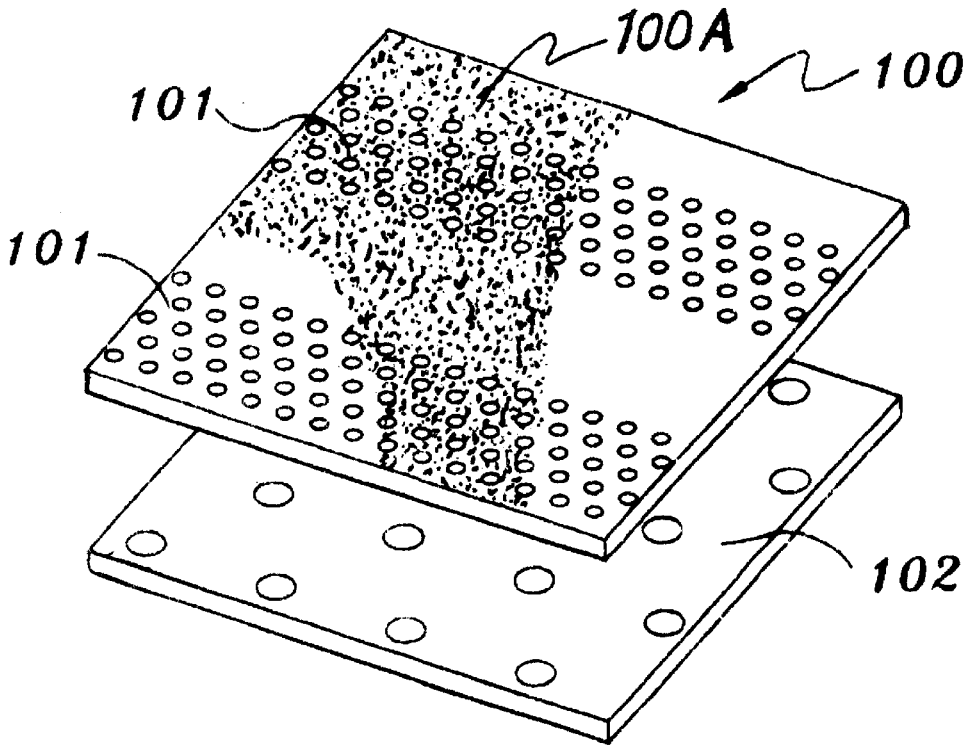
FIGS. 8, 9, 10 and 11 illustrate four different embodiments of the burner face used pursuant to the invention.

FIG. 8 is an enlarged illustration of a porous mat 100 (stippling 100A emphasizes the porosity of the entire mat) of sintered metal fibers which has been perforated along spaced bands 101 as taught in the previously cited patent to Duret et al. This preferred form of burner face is generally used with a metal or ceramic plate 102 spaced from the upstream side of burner face 100. Perforated shell is the term previously adopted for plate 102 because it is frequently curved, e.g., cylindrical as shown in FIG. 1 and FIG. 2. Perforated shell 102 with comparatively large perforations is disposed in the plenum of the burner to help achieve uniform flow toward all of burner face 100.

Figure 9:
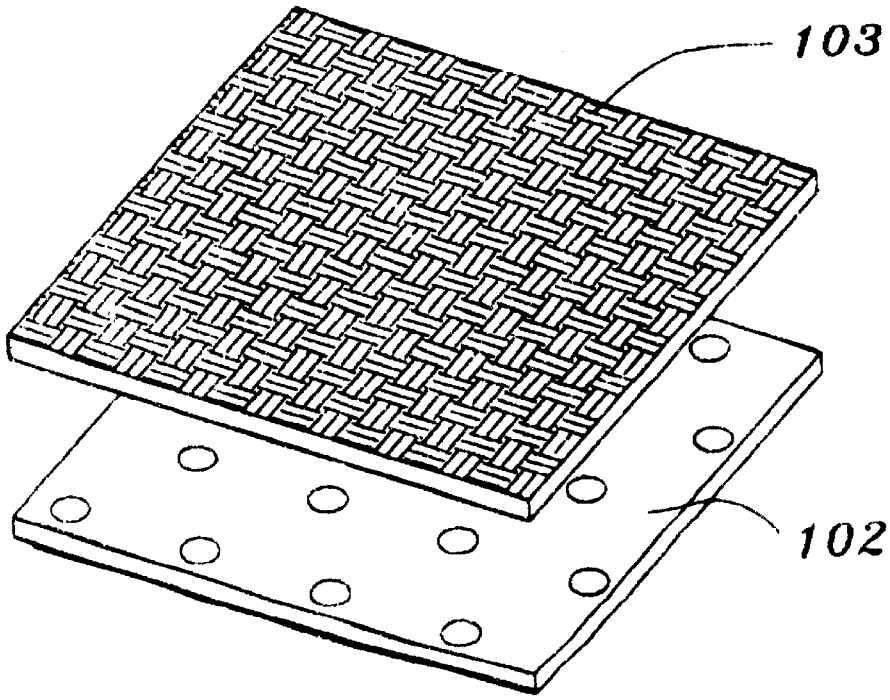

FIG. 9 similarly illustrates burner face 103 in the form of a knitted fabric made with a metal fiber yarn. In this case, perforated shell 102 serves to support face 103 as well as promote uniform gas flow thereto.

Figure 10:
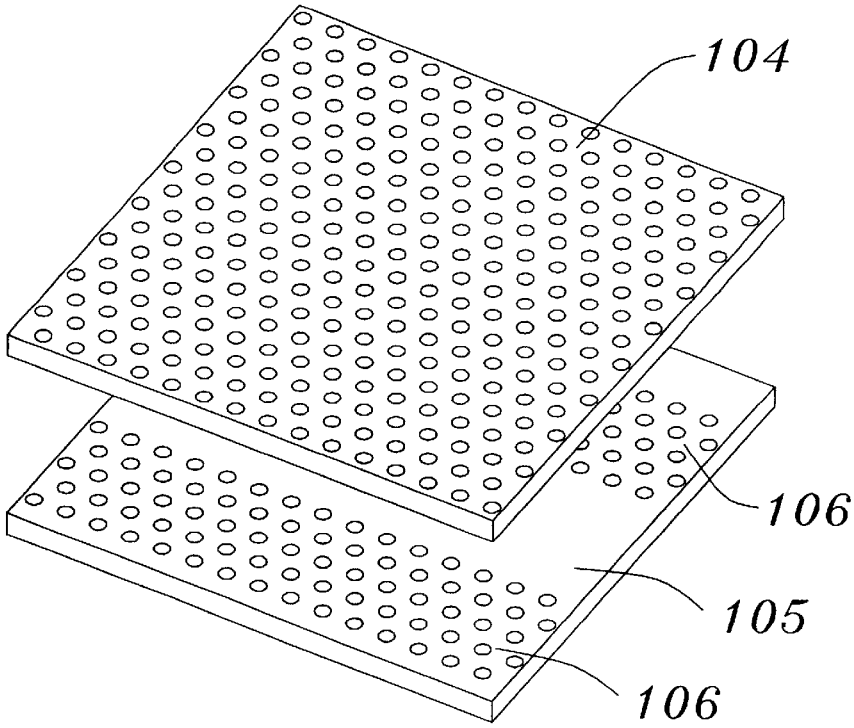

FIG. 10 shows a uniformly perforated burner face 104 and perforated shell 105 with perforations arranged in spaced bands 106. Face 104 made of sintered metal fibers may have porosity that is too low for providing radiant surface combustion. The perforations in face 104 are chosen to provide blue flame combustion. Perforated shell 105 is designed to reduce gas flow to some of the perforations in face 104. Specifically, the unperforated areas between perforated bands 106 of shell 105 diminish gas flow to perforations in face 104 Which are aligned with the unperforated areas. Such perforations receiving diminished flow will support surface combustion while other perforations of face 104 in line with perforated bands 106 will yield blue flame combustion. In lieu of the sintered metal fiber face 104, a uniformly perforated ceramic fiber face may be used to yield surface combustion with spaced bands of blue flame combustion.

Figure 11:
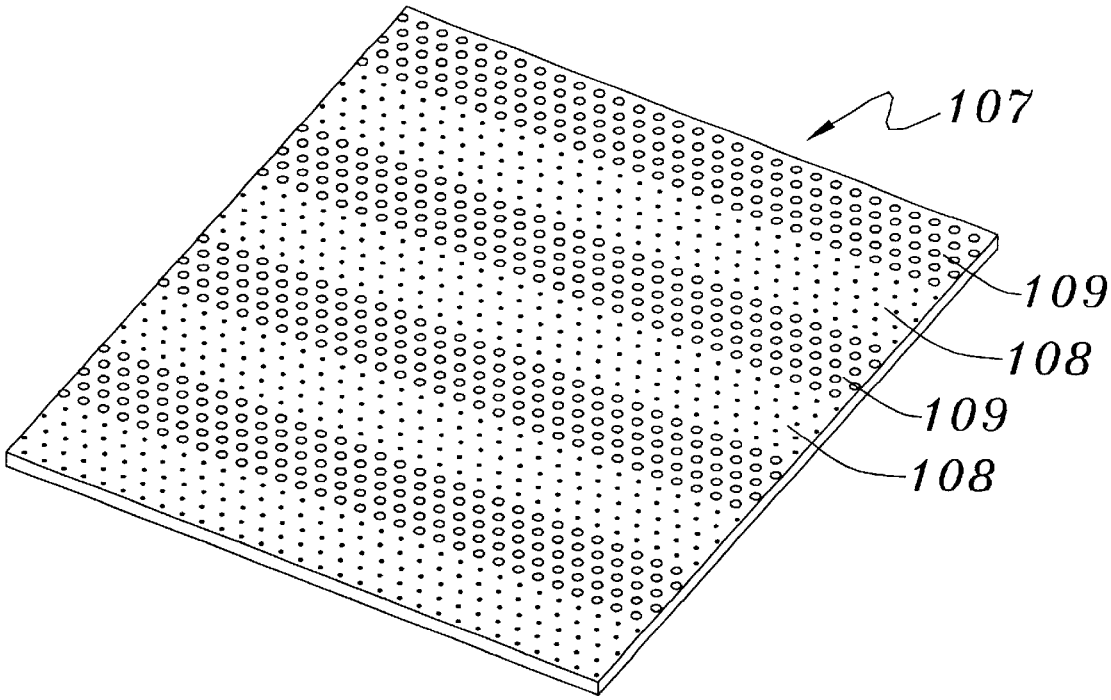

FIG. 11 presents burner face 107 with alternating bands 108 of small perforations and bands 109 of larger perforations. The perforations of bands 108 are dimensioned to yield radiant surface combustion when fired at atmospheric pressure while the larger perforations of bands 109 give blue flame combustion. As a rough guide, the open area of each larger perforation is usually about 20 times that of each small perforation. Burner face 107 is made of a low thermal conductivity material formed of metal or ceramic fibers. A preferred embodiment of burner face 107 is the ceramic fiber product of previously cited patents to Carswell provided with perforations of two sizes adapted to give the desired two types of combustion. As indicated in FIG. 11, burner face 107 may frequently be used without a perforated shell.

A burner face of the type illustrated in FIG. 8 is preferred in achieving combustion that yields product gases containing as little as 2 ppm $NO_X$ or less and yet no more than 10 ppm CO and UHC, combined. All of the burner faces that have been described, when fired at a pressure of at least 3 atmospheres and at a rate of at least about 500,000 BTU/hr/sf/atm, while controlling excess air in the fuel-air mixture fed to the burner face, are capable of delivering combustion product gases containing not more than 5 ppm $NO_X$ and not more than 10 ppm CO and UHC, combined. Depending on the temperature of the compressed air that is admixed with the gaseous fuel, excess air is varied between about 40% and 150%; the percentage of excess air is increased relative to higher temperatures of the compressed air to maintain an adiabatic flame temperature in the range of 2600° F. to 3300° F. Preferably, excess air is controlled to keep the adiabatic flame temperature in the range of 2750° F. to 2900° F. to drop the content of air pollutants in the combustion gases down to 2 ppm $NO_X$ or lower with not more than 10 ppm CO and UHC, combined.

Tests conducted with a burner like that of FIG. 4 with a face as shown in FIG. 8 and fired at 10 atmospheres with natural gas at the rate of 10,000,000 BTU/hr/sf kept the content of $NO_X$ in the combustion product gases below 2 ppm even though the temperature of the fuel-air mixture was increased as long as excess air was also increased. Specifically, the following tests produced less than 2 ppm $NO_X$.

| Fuel-Air Temperature ° F. | Excess Air Range |
|---|---|
| 400 | 55 to 67% |
| 600 | 66 to 81% |
| 800 | 81 to 98% |
| 1,000 | 98 to 118% |

The adiabatic flame temperatures of all the tests were maintained in the range of 2750° F. to 2900° F. by controlling excess air in the ranges given above. It is believed that such a high firing rate and the suppression of $NO_X$ to less than 2 ppm has never been even closely approached. Similar outstanding results are attainable when reducing the firing rate to 5,000,000 BTU/hr/sf or increasing that rate to 15,000,000 BTU/hr/sf; that means the operator has the freedom to vary the firing rate to a maximum at least three times the minimum at any given pressure. This operating flexibility is itself noteworthy.

While natural gas is a fuel commonly used with gas turbines, the burner of this invention may be fired with higher hydrocarbons, such as propane. Liquid fuels, such as alcohols and gasoline, may be used with the burner of the invention, if the liquid fuel is completely vaporized before it passes through the porous burner face. The term, gaseous fuel, has been used to include fuels that are normally gases as well as those that are liquid but completely vaporized prior to passage through the burner face. Another feature of the invention is that the burner is effective even with low BTU gases, such as landfill gas that often is only about 40% methane.

The term, excess air, has been used herein in its conventional way to mean the amount of air that is in excess of the stoichiometric requirement of the fuel with which it is mixed.

Those skilled in the art will readily visualize variations and modifications of the invention in light of the foregoing teachings without departing from the spirit or scope of the invention. For example, besides the flat and cylindrical forms of burner faces shown in the drawings, conical and domed shapes may be used. Many patents directed to means for controlling the flow of compressed air into the burners of gas turbines are certainly suggestive of substitutes for the movable plug schematically shown in the drawings to control the compressed air entering the burner. Accordingly, only such limitations should be imposed on the invention as are set forth in the appended claims.

What is claimed is:

1. An improved burner for gas turbines operable at high pressure with high excess air to produce combustion gases with low content of air pollutants, which comprises a plenum with an inlet for the injection of gaseous fuel and admixed compressed air, a porous fiber burner face attached across said plenum, said burner face having areas that yield, when fired at atmosperic pressure, radiant surface combustion and interspersed areas of higher porosity that yield blue flame combustion, a perforated shell within said plenum behind said burner face, and a metal liner positioned to provide a compact combustion zone adjacent said burner face, said liner having multiple openings to permit cooling compressed air to pass therethrough and merge with gases of said combustion zone.

2. The burner of claim 1 wherein the burner face is cylindrical surrounding a cylindrical plenum, the metal liner is also cylindrical, and the openings in said liner have louvers to promote film cooling of said liner.

3. The burner of claim 2 wherein the burner face is a porous metal fiber mat with interspersed perforated areas.

4. The burner of claim 1 wherein the plenum has an annular cylindrical form, the burner face is an inner cylindrical side of said plenum, the metal liner is tubular and extends axially along the length of said burner face, and the openings in said liner have louvers to promote film cooling of said liner.

5. The burner of claim 4 wherein the burner face is a porous metal fiber mat with interspersed perforated areas.

6. The burner of claim 1 wherein the burner face is a porous metal fiber mat with interspersed perforated areas.

7. The burner of claim 6 wherein the porous metal fiber mat, when fired at atmospheric pressure, can be fired at a rate of 35,000 to 200,000 BTU/hr/sf and the perforated areas can be fired at a rate in the range of 500,000 to 8,000,000 BTU/hr/sf.

8. A high-pressure burner for gas turbines operable with high excess air to suppress the formation of combustion air pollutants, with which comprises a plenum with an inlet for the injection of gaseous fuel and admixed compressed air, a porous fiber burner face in flow communication with said plenum, said burner face having dual porosities that, when fired at atmospheric pressure, yield radiant surface combustion interspersed with blue flame combustion, and a metal liner adapted for enhanced cooling positioned to confine combustion in a compact combustion zone adjacent said burner face.

9. The burner of claim 8 wherein the burner face and the metal liner are cylindrical, and said liner has louvered openings.

10. The burner of claim 9 wherein the burner face is a porous metal fiber mat with interspersed perforated areas.

11. The burner of claim 8 wherein the smaller of the dual porosities of the burner face, when fired at atmospheric pressure, can be fired at a rate of 35,000 to 200,000 BTU/hr/sf and the greater porosity can be fired at a rate of 500,000 to 8,000,000 BTU/hr/sf.

12. A high-pressure burner for gas turbines operable with high excess air to suppress the formation of combustion air pollutants, which comprises a plenum with an inlet for the introduction of gaseous fuel and admixed compressed air, a porous fiber burner face forming a side of said plenum, said burner face being sufficiently perforated to ensure a pressure drop therethrough of less than 3% and to produce a multiplicity of blue flames when fired at atmospheric pressure, a perforated shell within said plenum behind said burner face, and a metal liner disposed to form a compact combustion zone adjacent said burner face, said liner having multiple openings for the flow of cooling compressed air therethrough to merge with gases of said combustion zone.

13. The burner of claim 12 wherein the burner face and the metal liner are cylindrical, and the openings of said metal liner have louvers.

14. The burner of claim 13 wherein the burner face is a porous metal fiber mat with interspersed perforations.

15. The burner of claim 11 wherein the burner face and the metal liner are cylindrical, said burner face being a porous metal fiber mat with interspersed perforated areas.

* * * * *